US011560701B2

(12) United States Patent
DeVries

(10) Patent No.: US 11,560,701 B2
(45) Date of Patent: Jan. 24, 2023

(54) CONDUCTIVE BONNET NUT FOR AN ELECTRONIC FAUCET

(71) Applicant: Delta Faucet Company, Indianapolis, IN (US)

(72) Inventor: Adam DeVries, Anderson, IN (US)

(73) Assignee: Delta Faucet Company, Indianapolis, IN (US)

( * ) Notice: Subject to any disclaimer, the term of this patent is extended or adjusted under 35 U.S.C. 154(b) by 215 days.

(21) Appl. No.: 17/012,850

(22) Filed: Sep. 4, 2020

(65) Prior Publication Data

US 2022/0074177 A1 Mar. 10, 2022

(51) Int. Cl.
*E03C 1/05* (2006.01)
*E03C 1/04* (2006.01)

(52) U.S. Cl.
CPC ..... *E03C 1/055* (2013.01); *E03C 1/0403* (2013.01); *E03C 1/0404* (2013.01)

(58) Field of Classification Search
CPC ..... E03C 1/055; E03C 1/0403; E03C 1/0404
See application file for complete search history.

(56) References Cited

U.S. PATENT DOCUMENTS

| | | | |
|---|---|---|---|
| 4,685,467 | A | 8/1987 | Cartmell et al. |
| 4,775,501 | A | 10/1988 | Rosenzweig et al. |
| 4,932,795 | A | 6/1990 | Guinn |
| 5,002,716 | A | 3/1991 | Van Dijck |
| 5,030,487 | A | 7/1991 | Rosenzweig |
| 5,109,474 | A | 4/1992 | Cameron |
| 5,825,608 | A | 10/1998 | Duva et al. |
| 6,402,205 | B1 | 6/2002 | Rose et al. |
| 6,545,854 | B2 | 4/2003 | Trinh et al. |
| 6,947,012 | B2 | 9/2005 | Aisenbrey |
| 7,092,766 | B1 | 8/2006 | Salys et al. |
| 7,308,738 | B2 | 12/2007 | Barvosa-Carter et al. |
| 7,374,644 | B2 | 5/2008 | Butterfield et al. |
| 7,690,395 | B2 | 4/2010 | Jonte et al. |
| 7,753,074 | B2 | 7/2010 | Rosko et al. |
| 7,928,324 | B2 | 4/2011 | Moore |
| 8,127,782 | B2 | 3/2012 | Jonte et al. |

(Continued)

FOREIGN PATENT DOCUMENTS

| | | |
|---|---|---|
| EP | 2907199 | 8/2015 |
| JP | 2005088669 A | 4/2005 |

(Continued)

OTHER PUBLICATIONS

Misumi Corporation, Conductive Resin Washer, retrieved from https://us.misumi-ec.com/vona2/detail/221004919435 on May 12, 2020, 3 pages.

(Continued)

*Primary Examiner* — Patrick C Williams
(74) *Attorney, Agent, or Firm* — Bose McKinney & Evans LLP

(57) ABSTRACT

An electronic faucet including a delivery spout, a valve cartridge, a bonnet nut securing the valve cartridge within the delivery spout, and a handle operably coupled to a valve stem of the valve cartridge. The bonnet nut is illustratively formed of a conductive polymer. A contact spring is supported by the valve stem, wherein an electrically conductive path extends from the faucet handle, the contact spring, the bonnet nut and the delivery spout.

34 Claims, 6 Drawing Sheets

(56) References Cited

U.S. PATENT DOCUMENTS

| | | | | |
|---|---|---|---|---|
| 8,297,305 | B2 | 10/2012 | Ritter et al. | |
| 8,337,229 | B2 | 12/2012 | Montena | |
| 8,413,929 | B2 | 4/2013 | Kamino et al. | |
| 8,492,165 | B2 | 7/2013 | Van Pelt et al. | |
| 8,528,579 | B2 | 9/2013 | Jonte et al. | |
| 8,613,419 | B2 | 12/2013 | Rodenbeck et al. | |
| 8,791,375 | B2 | 7/2014 | Fisher et al. | |
| 8,844,564 | B2 | 9/2014 | Jonte et al. | |
| 8,920,356 | B2 | 12/2014 | Shang et al. | |
| 8,944,105 | B2 | 2/2015 | Rodenbeck et al. | |
| 8,997,802 | B2 | 4/2015 | Lolli et al. | |
| 9,084,546 | B2 | 7/2015 | Richardson-Burns et al. | |
| 9,175,458 | B2 | 11/2015 | Meehan et al. | |
| 9,203,167 | B2 | 12/2015 | Holliday et al. | |
| 9,205,567 | B2 | 12/2015 | Rose et al. | |
| 9,243,390 | B2 | 1/2016 | Rosko et al. | |
| 9,243,391 | B2 | 1/2016 | Jonte et al. | |
| 9,243,392 | B2 | 1/2016 | Marty et al. | |
| 9,243,756 | B2 | 1/2016 | Davidson et al. | |
| 9,306,324 | B2 | 4/2016 | Wei | |
| 9,398,927 | B2 | 7/2016 | Baehre et al. | |
| 9,714,501 | B2 | 7/2017 | Keiter et al. | |
| 9,857,012 | B2 | 1/2018 | Kwak | |
| 10,301,801 | B2 | 5/2019 | Sawaski | |
| 10,381,607 | B2 | 8/2019 | Shin et al. | |
| 11,306,845 | B2 | 4/2022 | Tang et al. | |
| 11,326,715 | B2 | 5/2022 | DeVries et al. | |
| 2002/0084654 | A1 | 7/2002 | Katayama et al. | |
| 2006/0016552 | A1 | 1/2006 | Barbone et al. | |
| 2010/0170570 | A1* | 7/2010 | Rodenbeck | E03C 1/055 137/1 |
| 2010/0295299 | A1 | 11/2010 | Ziu | |
| 2013/0032216 | A1* | 2/2013 | Sawaski | E03C 1/055 251/129.01 |
| 2014/0168172 | A1 | 6/2014 | Zeliff et al. | |
| 2014/0259627 | A1 | 9/2014 | Lenahan et al. | |
| 2014/0261750 | A1* | 9/2014 | Rosko | F16K 19/006 137/78.1 |
| 2014/0261780 | A1* | 9/2014 | Thomas | E03C 1/057 137/801 |
| 2016/0215482 | A1* | 7/2016 | Fourman | E03C 1/0404 |
| 2018/0307329 | A1 | 10/2018 | Rollon et al. | |
| 2019/0337823 | A1 | 11/2019 | Leys et al. | |
| 2021/0254748 | A1 | 8/2021 | DeVries et al. | |
| 2021/0254749 | A1 | 8/2021 | Tang et al. | |

FOREIGN PATENT DOCUMENTS

| | | |
|---|---|---|
| KR | 200366554 Y1 | 10/2004 |
| KR | 20090007941 U | 8/2009 |
| WO | 2005025362 | 3/2005 |

OTHER PUBLICATIONS

Igus Inc., Conductive Polymer Bail Roller, retrieved from https://www.igus.com/product/20160 on May 12, 2020, 3 pages.

Oiles Corporation, Conductive Plastic Bearings, retrieved from https://www.oilesglobal.com/page-america/en/bearing/oiles_bearing/tech_data/doudensei on May 12, 2020, 2 pages.

P + H Pluss AG, CFRP Collar Nuts, retrieved from http://www.pluessag.ch/en/cfrp-products/cfrp-profile/cfrp-collar-nut.html on May 12, 2020, 6 pages.

Martins et al., Highly Conductive Carbon Fiber-Reinforced Polymer Composite Electronic Box: Out-of-Autoclave Manufacturing for Space Applications, Fibers 2018, 6, 92, retrieved from https://www.mdpi.com/journal/fibers, 23 pages.

* cited by examiner

CONDUCTIVE BONNET NUT FOR AN ELECTRONIC FAUCET

BACKGROUND AND SUMMARY OF THE DISCLOSURE

The present disclosure relates generally to an electronic faucet and, more particularly, to a conductive bonnet nut for providing an electrical flow path between a faucet handle and a faucet spout.

Automatic and electronic faucets (hereinafter referred to as electronic faucets), such as those including capacitive control or sensing features, are becoming increasingly popular, particularly in residential households. Exemplary electronic faucets are disclosed in U.S. Pat. No. 7,690,395, entitled "Multi-Mode Hands Free Automatic Faucet", U.S. Pat. No. 8,127,782, entitled "Multi-Mode Hands Free Automatic Faucet", U.S. Pat. No. 8,528,579, entitled "Multi-Mode Hands Free Automatic Faucet", U.S. Pat. No. 8,613,419, entitled "Capacitive Coupling Arrangement for a Faucet", U.S. Pat. No. 8,844,564, entitled "Multi-Mode Hands Free Automatic Faucet", U.S. Pat. No. 8,944,105, entitled "Capacitive Sensing Apparatus and Method for Faucets", U.S. Pat. No. 9,243,390, entitled "Capacitive Sensing Faucet including a Conductive Polymer", and U.S. Pat. No. 9,243,756, entitled "Capacitive User Interface", the disclosures of which are expressly incorporated herein by reference.

The present invention provides for a conductive polymer bonnet nut which allows for electronic faucets to create an electrically conductive path between a handle and a delivery spout while using an inert material. This allows for bonnet nuts formed of a consistent material for use with faucets including spouts formed of a variety of materials. Without this, the bonnet nut material would need to be compatible with the spout material of each different faucet to prevent galvanic corrosion.

According to an illustrative embodiment of the present disclosure, an electronic faucet includes a first faucet component formed of an electrically conducted material, a second faucet component formed of an electrically conducted material, and a capacitive sensor operably coupled to the first faucet component. A controller is operably coupled to the capacitive sensor, wherein an outlet signal from the capacitive sensor is supplied to the controller. A mounting nut is threadably coupled to the first faucet component, the mounting nut being formed of an electrically conductive polymer. A contact spring extends between a first end and a second end, the first end being in electrical contact with a mounting nut, and the second end being in electrical contact with the second faucet component. The contact spring is formed of an electrically conductive material. An electrically conducted path extends from the second faucet component, the contact spring, the mounting nut and the first faucet component to the capacitive sensor.

According to a further illustrative embodiment of the present disclosure, an electronic faucet includes a faucet spout formed of an electrically conductive material, a faucet handle formed of an electrically conductive material, and a capacitive sensor operably coupled to the faucet spout. A controller is operably coupled in the capacitive sensor, wherein an outlet signal from the capacitive sensor is supplied to the controller. A bonnet nut is threadably coupled to the faucet spout, the bonnet nut being formed of an electrically conductive polymer. An electrically conductive member extends between a first end and a second end, the first end in electrical contact with the bonnet nut, and the second end in electrical contact with the faucet handle. A valve cartridge is secured within the faucet spout by the bonnet nut, the valve cartridge including a valve stem operably coupled to the faucet handle. An electrically conductive path extends from the faucet handle, the electrically conductive member, the bonnet nut and the faucet spout to the capacitive sensor.

According to another illustrative embodiment of the present disclosure, an electronic faucet includes a faucet spout formed of an electrically conductive material, a faucet handle formed of an electrically conductive material, and a bonnet nut threadably coupled to the faucet spout, the bonnet nut being formed of an electrically conductive polymer. A contact spring extends between a first end and a second end, the first end in electrical contact with the bonnet nut, and the second end in electrical contact with the faucet handle. The contact spring is formed of an electrically conductive material. A valve cartridge is secured within the faucet spout by the bonnet nut, the valve cartridge including a valve stem operably coupled to the faucet handle. An electrically conducted path extends from the faucet handle, the contact spring, the bonnet nut and the faucet spout.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

Figure 1:
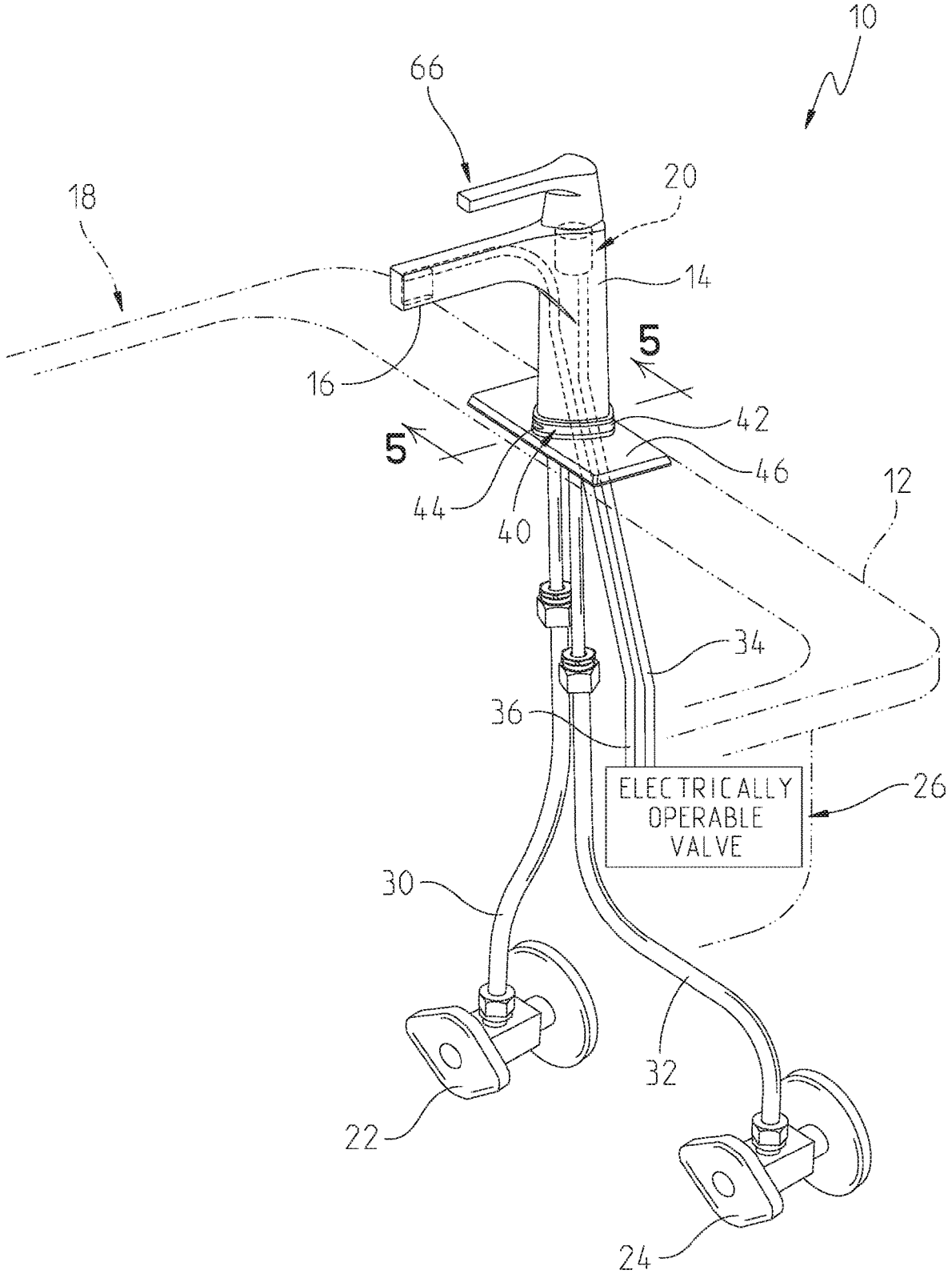
FIG. 1 is a perspective view of an electronic faucet according to an illustrative embodiment of the present disclosure, shown mounted to a sink deck.

For the purposes of promoting an understanding of the principles of the present disclosure, reference will now be made to the embodiments illustrated in the drawings, which are described herein. The embodiments disclosed herein are not intended to be exhaustive or to limit the invention to the precise form disclosed. Rather, the embodiments are chosen and described so that others skilled in the art may utilize their teachings. Therefore, no limitation of the scope of the claimed invention is thereby intended. The present invention includes any alterations and further modifications of the illustrated devices and described methods and further applications of principles in the invention which would normally occur to one skilled in the art to which the invention relates.

Figure 2:
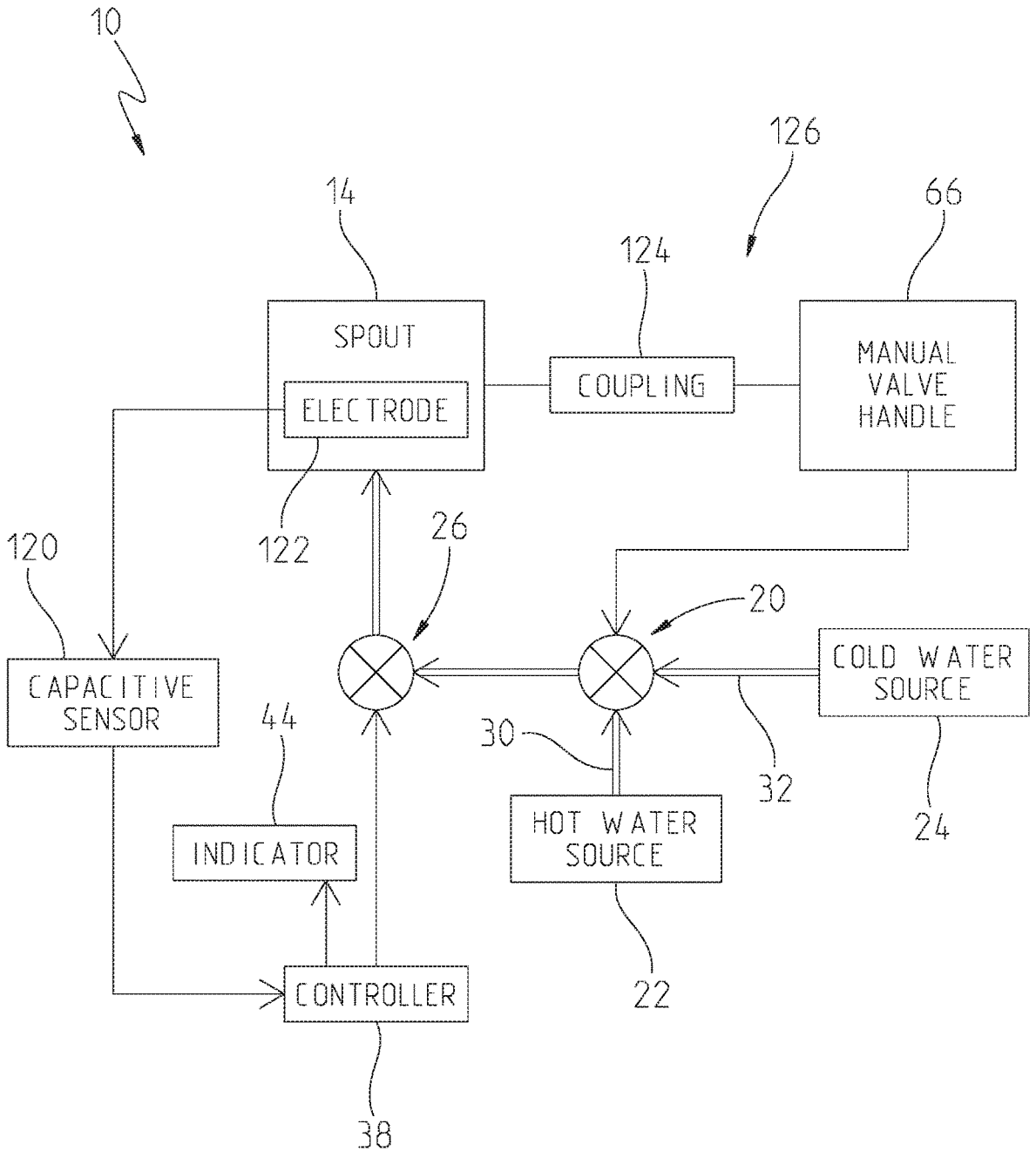
FIG. 2 is a block diagram of the illustrative electronic faucet of FIG. 1.
Figure 3:
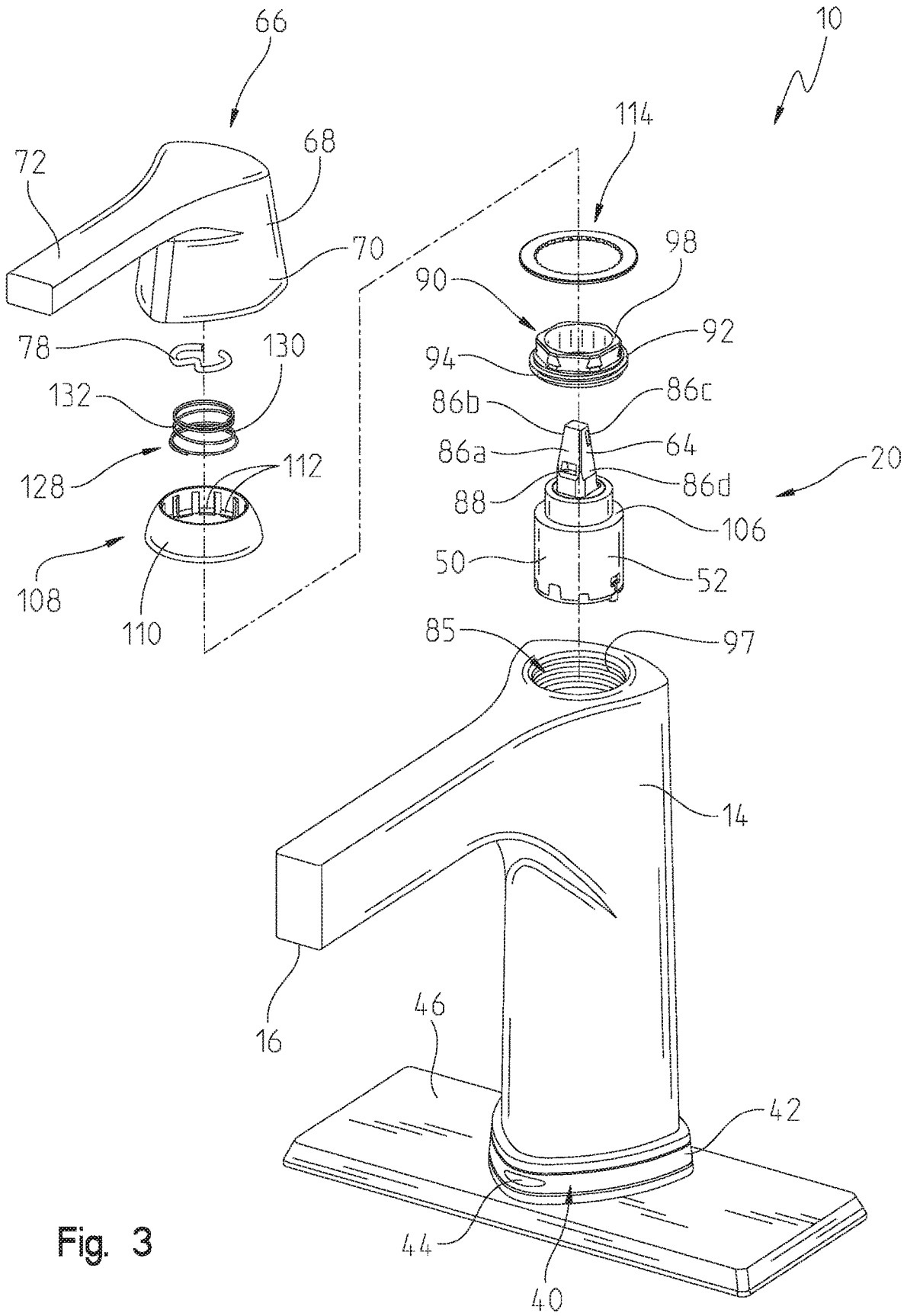
FIG. 3 is a partially exploded top perspective view of the illustrative electronic faucet of FIG. 1.

With reference initially to FIGS. 1 and 2, an electronic faucet 10 is illustrated as being supported by a conventional support, such as a mounting or sink deck 12. The illustrative electronic faucet 10 includes a delivery spout 14 supporting a water outlet 16 for dispensing water into a sink basin 18 supported by the sink deck 12. The water outlet 16 may be defined by a conventional aerator. The delivery spout 14 is illustratively formed of an electrically conductive material, such as die cast zinc with a chrome plated or PVD finished surface.

A manual valve 20 is illustratively supported by the delivery spout 14 and is fluidly coupled to a hot water source 22 and a cold water source 24. The hot water source 22 and the cold water source 24 may be defined by conventional water valve stops (FIG. 1). In an illustrative embodiment, an electrically operable valve 26 is fluidly coupled in series with, and downstream from, the manual valve 20. More particularly, a flexible hot water inlet tube 30 fluidly couples the hot water source 22 to the manual valve 20, and a flexible cold water inlet tube 32 fluidly couples the cold water source 24 to the manual valve 20. A flexible connecting tube 34 fluidly couples the manual valve 20 to the electrically operable valve 26. A flexible outlet tube 36 fluidly couples the electrically operable valve 26 to the water outlet 16. The tubes 30, 32, 34 and 36 may be formed of a polymer, illustratively a cross-linked polyethylene (PEX).

The electrically operable valve 26 is illustratively in electrical communication with a controller 38. An insulator base 40 is illustratively positioned intermediate the delivery spout 14 and the sink deck 12. The insulator base 40 illustratively includes a body 42 formed of an electrically insulating material, such as a polymer, and supports an indicator light 44. The indicator light 44 is in electrical communication with the controller 38 and may provide, for example, an indication of faucet status (e.g., on/off, low battery, etc.) or a parameter of water (e.g., color indicating temperature, intensity indicating flow rate, etc.) supplied to the outlet 16. An escutcheon or trim 46 illustratively supports the insulator base 40.

Figure 4:
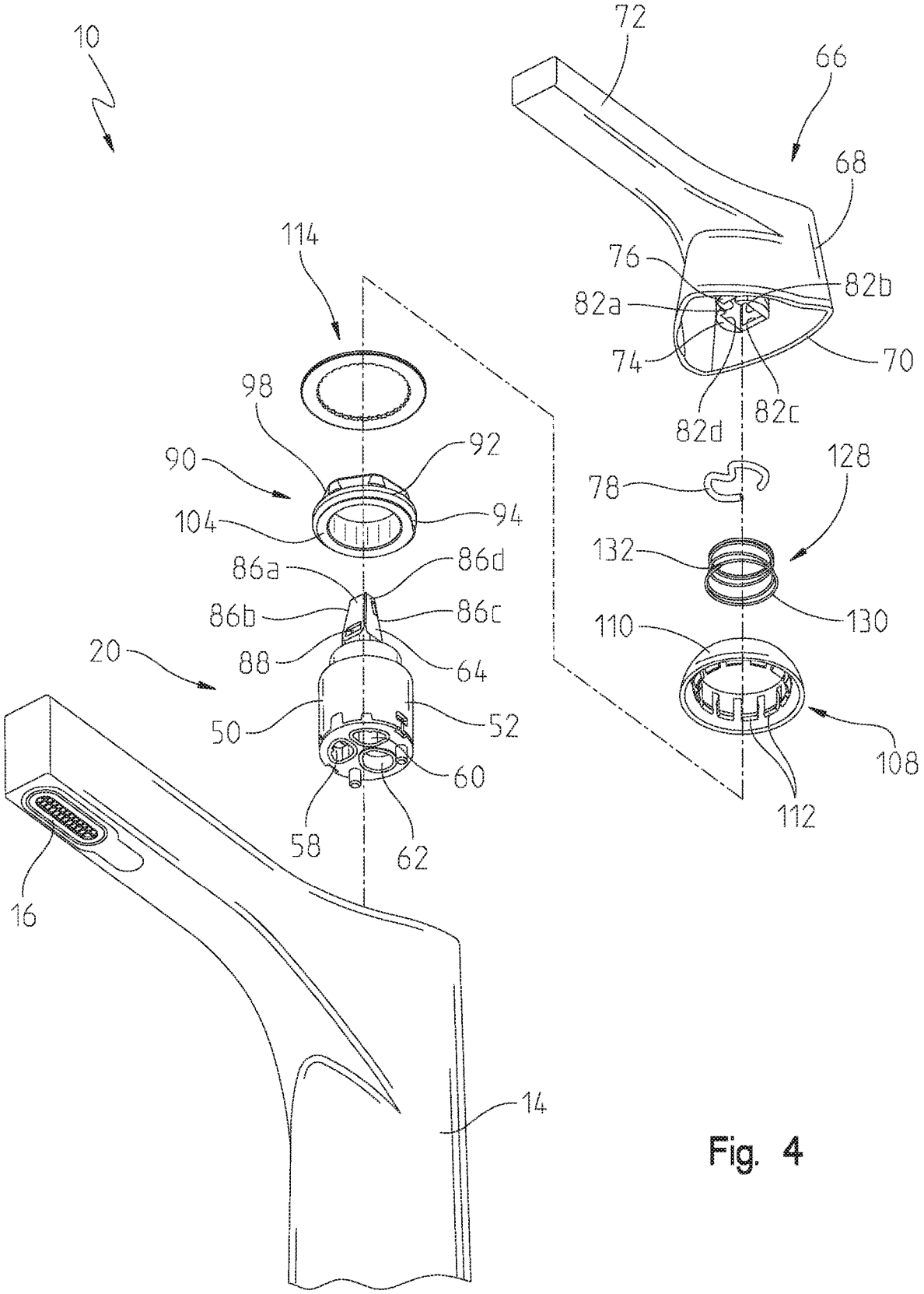
FIG. 4 is a partially exploded bottom perspective view of the illustrative electronic faucet of FIG. 1.
Figure 5:
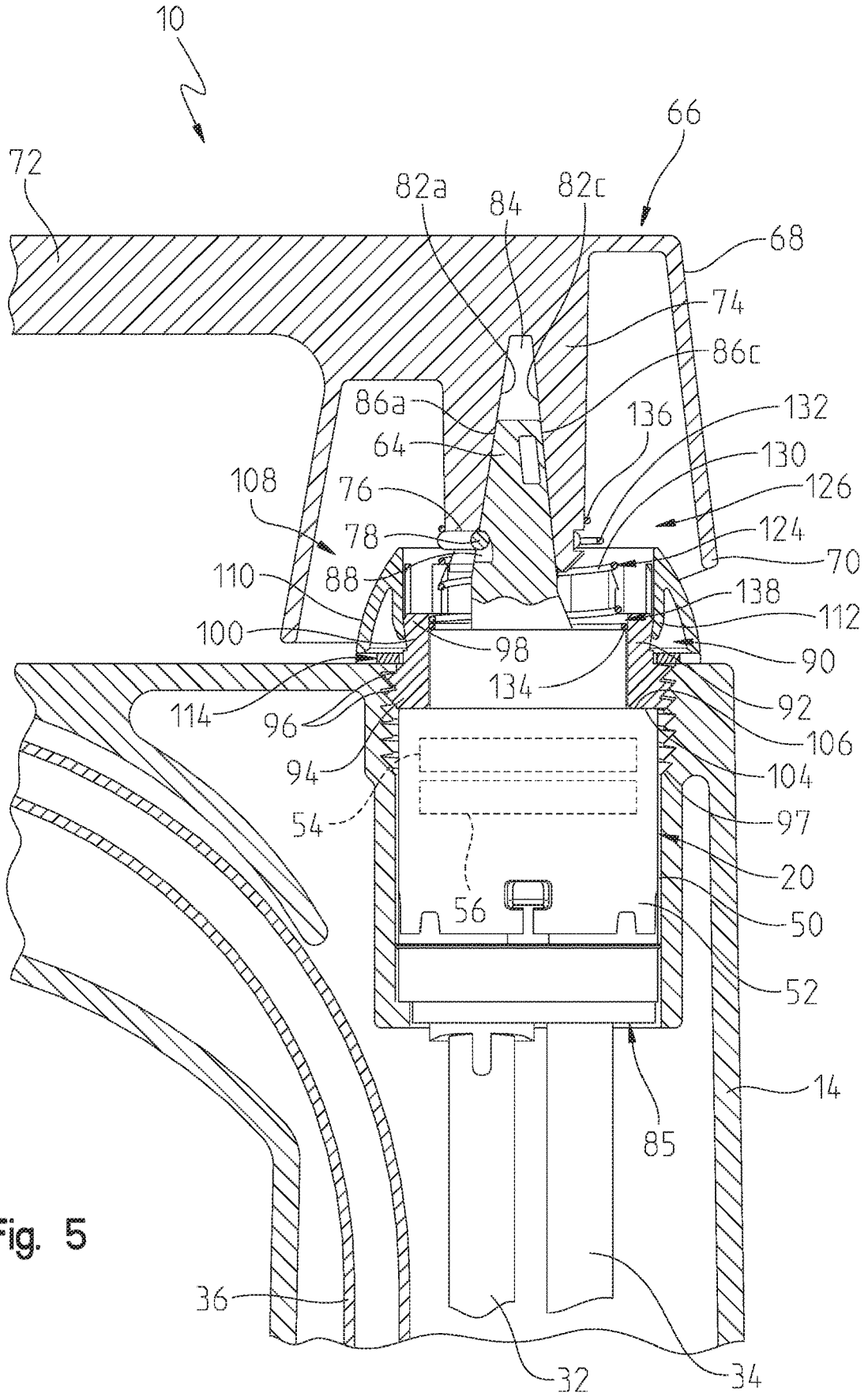
FIG. 5 is a cross-sectional view taken along line 5-5 of FIG. 1.

The illustrative manual valve 20 includes a valve cartridge 50 having an outer housing 52 receiving an upper (movable) flow control member 54 and a lower (fixed) flow control member 56 (FIG. 5). The flow control members 54 and 56 may be ceramic discs. Illustratively, the outer housing 52 is formed of a polymer and is therefore electrically non-conductive. The flow control members 54 and 56 control the flow of water from hot and cold water inlets 58 and 60 to a mixed water outlet 62 (FIG. 4). The hot water inlet 58 is fluidly coupled to the hot water inlet tube 30, the cold water inlet 60 is fluidly coupled to the cold water inlet tube 32, and the mixed water outlet 62 is fluidly coupled to the connecting tube 34.

The valve cartridge 50 further includes a valve stem 64 operably coupled to the upper flow control member 54. The valve stem 64 may be formed of a polymer, such as a nylon, and is therefore electrically non-conductive. The valve cartridge 50 may be a conventional mixing valve that mixes the hot and cold water entering the manual valve 20 from inlet tubes 30 and 32, respectively. In an illustrative embodiment, the valve cartridge 50 may be of the type described in U.S. Pat. No. 7,753,074, entitled "Mixing Valve", which is expressly incorporated herein by reference.

The valve stem 64 is operably coupled to a faucet handle 66 including a body 68 having a base 70 and a blade 72. The handle body 68 further includes a receiver 74 positioned inwardly from the base 70. A slot 76 extends within the receiver 74 and receives a portion of a wire form retainer 78. The wire form retainer 78 may be comprised of metal or plastic and may be circular, or another shape with resilient properties. In one illustrative embodiment, the wire form retainer 78 is formed of stainless steel.

The receiver 74 of the handle body 68 includes at least one vertically tapered side wall 82 defining a receiving chamber 84. In the illustrative embodiment, four vertically tapered side walls 82*a*, 82*b*, 82*c*, 82*d* define the receiving chamber 84 having a rectangular transverse cross-section. The slot 76 extends through the tapered side wall 82*a* into the receiving chamber 84. The wire form retainer 78 is coupled around the receiver 74 and is at least partially disposed within the slot 76 and extends into the receiving chamber 84.

As noted above, the delivery spout 14 illustratively receives and supports the valve cartridge 50 within an opening or chamber 85. Illustratively, the valve stem 64 of the valve cartridge 50 is tapered. More particularly, the valve stem 64 includes inclined or tapered surfaces 86*a*, 86*b*, 86*c*, 86*d* cooperating with the side walls 82*a*, 82*b*, 82*c*, 82*d* of the receiver 74. The valve stem 64 illustratively includes a retaining recess or groove 88 formed within the tapered surface 86*a*.

To couple the valve cartridge 50 to the handle 66, the tapered valve stem 64 is received within the receiving chamber 84 of the receiver 74 so that at least a portion of the wire form retainer 78 extends through the slot 76 of the receiver 74 and is received within the retaining groove 88 of the tapered valve stem 64. Additionally, to help limit unwanted movement, the surfaces 86 of the tapered valve stem 64 and the tapered side wall 82 of the receiver 74 have matching taper angles. Additional details of an illustrative coupling between the valve stem 64 and the handle 66 are provided in U.S. patent application Ser. No. 16/791,455, filed on Feb. 14, 2020, and entitled "Snap-On Faucet Handle", the disclosure of which is incorporated herein by reference.

A mounting or bonnet nut 90 illustratively secures the valve cartridge 50 within the spout 14. The mounting nut 90 includes a body 92 illustratively formed of a non-metallic, electrically conductive material. In certain illustrative embodiments, the body 92 is molded from a polymer including carbon fibers. More particularly, the body 92 may be molded from a conductive acrylonitrile butadiene styrene.

The body 92 of the bonnet nut 90 includes a lower portion 94 including a plurality of external threads 96 engaging with internal threads 97 of opening 85 of the delivery spout 14. An upper portion 98 includes a cylindrical wall 100 including tool engagement elements, illustratively flats 102. A lower engagement surface 104 engages with an upper flange or rim 106 of the outer housing 52 of the valve cartridge 50.

A bonnet cap 108 is positioned around the bonnet nut 90. More particularly, the bonnet cap 108 includes a semi-spherical wall 110. Circumferentially spaced fingers 112 extend inwardly from the wall 110. When assembled, the bonnet cap 108 extends partially into the handle body 68, and the retaining groove 88 is below an upper edge of the bonnet cap 108. In other words, the handle 66 captures the valve stem 64 between the tapered receiving chamber 84 in the handle 66 and a wire form retainer 78 that is supported by the receiver 74. The location of the wire form retainer 78 can be below the top of the bonnet cap 108 because it does not need to be accessed during removal or assembly.

A temperature indicator ring 114 is illustratively received around the cylindrical wall 100 of the bonnet nut 90. The temperature indicator ring 114 may be formed of a polymer, such as a low density polyethylene (LDPE). Illustratively, the temperature indicator ring 114 may support at least one light emitting diode (LED)(not shown) electrically coupled to the controller 38 and configured to provide an indication of water temperature supplied to the outlet 16. For example, the LED may emit a blue color to indicate cold water, and a red color to indicate hot water.

A capacitive sensor 120 is illustratively in electrical communication with the controller 38 such that an output signal from the capacitive sensor 120 is supplied to the controller 38. The capacitive sensor 120 may be electrically coupled to the delivery spout 14. More particularly, an electrode 122 may be coupled to the delivery spout 14. Illustratively, the electrode 122 may be the delivery spout 14 itself, a portion thereof, or a metal element coupled thereto.

Figure 6:
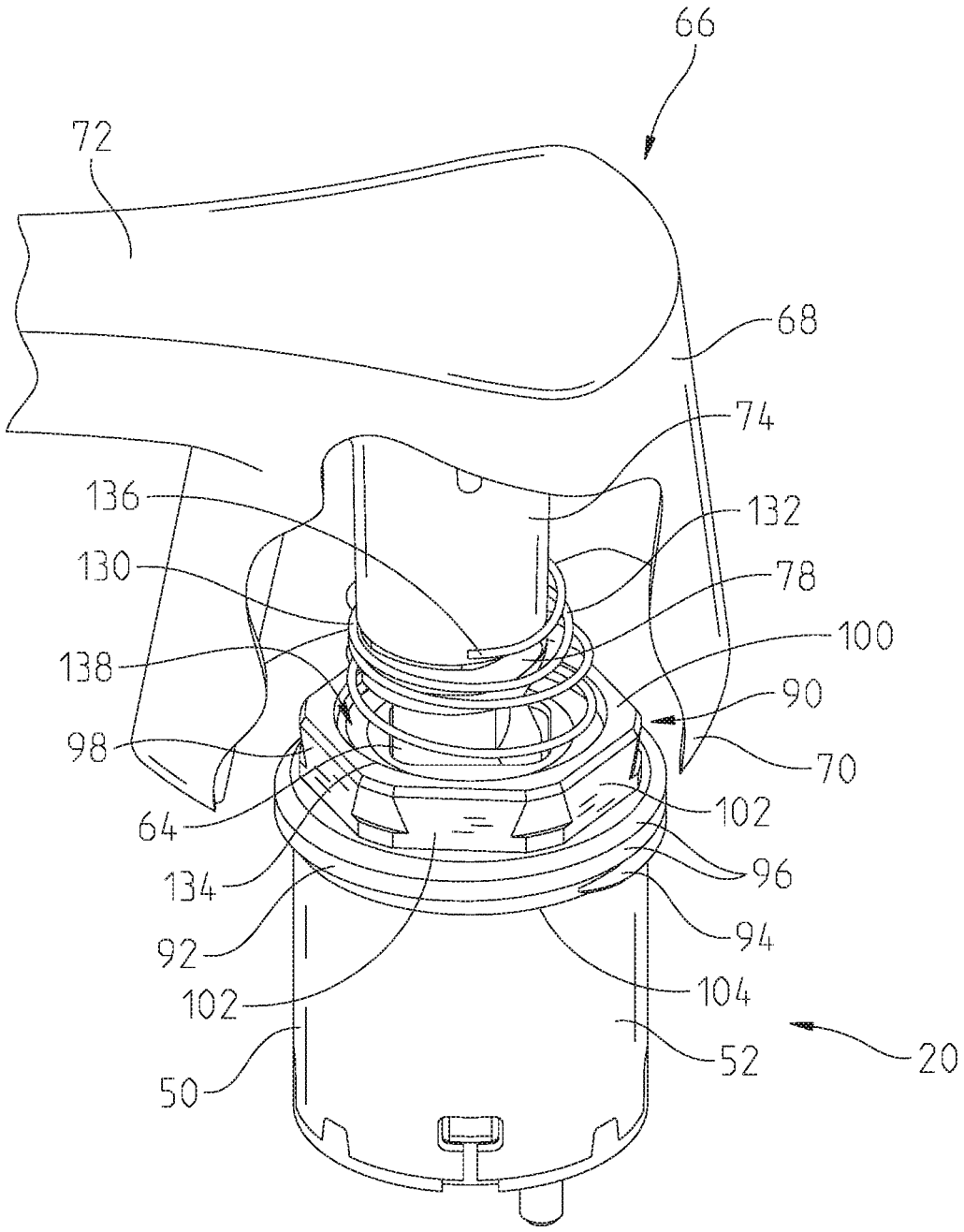
FIG. 6 is a perspective view of the faucet handle coupled to the valve cartridge of the illustrative electronic faucet of FIG. 1, with a cut-away showing an electrically conductive path extending from the faucet handle, through the contact spring, and the mounting nut.

With reference to FIGS. 5 and 6, an electrical coupling 124 defines an electrically conductive path 126 between the delivery spout 14 and the faucet handle 66. An electrically conductive member provides electrical communication between the delivery spout 14 and the faucet handle 66. Illustratively, the conductive member is a contact spring 128 including a metal wire 130 defining a coil 132. The wire 130 of the contact spring 128 extends between a first end 134 and a second end 136. The coil 132 receives the valve stem 64 wherein the first end 134 is in electrical contact with the mounting nut 90, and the second end 136 is in electrical contact with the faucet handle 66. More particularly, the first end 134 of the contact spring 128 is received within an upper opening 138 of the mounting nut 90. The second end 136 of the contact spring 128 extends around and is in contact with the receiver 74 of the faucet handle 66.

The outlet 62 of the valve cartridge 50 is fluidly coupled to the electrically operable valve 26, which is controlled electronically by input signals from the controller 38. In an illustrative embodiment, the electrically operable valve 26 is a magnetically latching pilot-controlled solenoid valve.

Because the electrically operable valve 26 is controlled electronically by the controller 38, flow of water can be controlled using outputs from sensors as discussed herein. As shown in FIG. 2, when the electrically operable valve 26 is open, the electronic faucet 10 may be operated in a conventional manner, i.e., in a manual control mode through operation of the handle 66 and the flow control member 54 of the manual valve 20. Conversely, when the manual valve 20 is set to select a water temperature and flow rate, the electrically operable valve 26 can be touch (or proximity) controlled, by the capacitive sensor 120 when an object (such as a user's hands) is in contact with the spout 14 (or are within a detection zone adjacent the spout 14) to toggle water flow on and off.

Although the invention has been described in detail with reference to certain preferred embodiments, variations and modifications exist within the spirit and scope of the invention as described and defined in the following claims.

The invention claimed is:

1. An electronic faucet comprising:

a first faucet component formed of an electrically conductive material;

a second faucet component formed of an electrically conductive material;

a capacitive sensor operably coupled to the first faucet component;

a controller operably coupled to the capacitive sensor, an output signal from the capacitive sensor being supplied to the controller;

a mounting nut threadably coupled to the first faucet component, the mounting nut being formed of an electrically conductive polymer;

a contact spring extending between a first end and a second end, the first end in electrical contact with the mounting nut, and the second end in electrical contact with the second faucet component, the contact spring formed of an electrically conductive material;

wherein an electrically conductive path extends from the second faucet component, the contact spring, the mounting nut and the first faucet component to the capacitive sensor; and wherein the first faucet component comprises a faucet spout.

2. The electronic faucet of claim 1, wherein the second faucet component comprises a faucet handle.

3. The electronic faucet of claim 2, further comprising a valve cartridge secured within the faucet spout by the mounting nut, the valve cartridge including a valve stem coupled to the faucet handle.

4. The electronic faucet of claim 3, wherein the mounting nut includes external threads, the spout includes internal threads engaging the external threads of the mounting nut, the valve cartridge including an outer housing with a lip engaged by a lower end of the mounting nut.

5. The electronic faucet of claim 4, wherein the contact spring is received within an upper opening of the mounting nut.

6. The electronic faucet of claim 3, wherein:

the faucet handle includes:

a handle body, a receiver defined by the handle body and including at least one vertically tapered side wall defining a receiving chamber, a slot extending through the tapered side wall into the receiving chamber, and a wire form retainer, coupled around the receiver and being at least partially disposed within the slot for extending into the receiving chamber;

the valve stem is tapered and includes a retaining groove; and wherein the valve stem is received within the receiving chamber of the receiver so that at least a portion of the wire form retainer extends through the slot of the receiver and is received within the retaining groove of the valve stem.

7. The electronic faucet of claim 3, further comprising an electrically operable valve in electrical communication with the controller.

8. The electronic faucet of claim 7, wherein the valve cartridge comprises a mixing valve in series with the electrically operable valve, the mixing valve in fluid communication with a hot water supply and a cold water supply.

9. The electronic faucet of claim 1, wherein the mounting nut is formed of a polymer including carbon fibers.

10. The electronic faucet of claim 1, wherein the mounting nut is formed of a conductive acrylonitrile butadiene styrene.

11. An electronic faucet comprising:

a faucet spout formed of an electrically conductive material;

a faucet handle formed of an electrically conductive material;

a capacitive sensor operably coupled to the faucet spout;

a controller operably coupled to the capacitive sensor, an output signal from the capacitive sensor being supplied to the controller;

a bonnet nut threadably coupled to the faucet spout, the bonnet nut being formed of an electrically conductive polymer;

an electrically conductive member extending between a first end and a second end, the first end in electrical contact with the bonnet nut, and the second end in electrical contact with the faucet handle;

a valve cartridge secured within the faucet spout by the bonnet nut, the valve cartridge including a valve stem operably coupled to the faucet handle; and wherein an electrically conductive path extends from the faucet handle, the electrically conductive member, the bonnet nut and the faucet spout to the capacitive sensor.

12. The electronic faucet of claim 11, wherein the electrically conductive member comprises a metal wire.

13. The electronic faucet of claim 12, wherein the electrically conductive member comprises a contact spring.

14. The electronic faucet of claim 13, wherein the bonnet nut includes external threads, the spout includes internal threads engaging the external threads of the bonnet nut, the valve cartridge including an outer housing with a lip engaged by a lower end of the bonnet nut.

15. The electronic faucet of claim 14, wherein the contact spring is received within an upper opening of the bonnet nut.

16. The electronic faucet of claim 11, wherein:

the faucet handle includes:

a handle body, a receiver defined by the handle body and including at least one vertically tapered side wall defining a receiving chamber, a slot extending through the tapered side wall into the receiving chamber, and a wire form retainer, coupled around the receiver and being at least partially disposed within the slot for extending into the receiving chamber;

the valve stem is tapered and includes a retaining groove; and wherein the valve stem is received within the receiving chamber of the receiver so that at least a portion of the wire form retainer extends through the slot of the receiver and is received within the retaining groove of the valve stem.

17. The electronic faucet of claim 11, wherein the bonnet nut is formed of a polymer including carbon fibers.

18. The electronic faucet of claim 11, wherein the bonnet nut is formed of a conductive acrylonitrile butadiene styrene.

19. The electronic faucet of claim 11, further comprising an electrically operable valve in electrical communication with the controller.

20. The electronic faucet of claim 19, wherein the valve cartridge comprises a mixing valve in series with the electrically operable valve, the mixing valve in fluid communication with a hot water supply and a cold water supply.

21. An electronic faucet comprising:

a faucet spout formed of an electrically conductive material;

a faucet handle formed of an electrically conductive material;

a bonnet nut threadably coupled to the faucet spout, the bonnet nut being formed of an electrically conductive polymer;

a contact spring extending between a first end and a second end, the first end in electrical contact with the bonnet nut, and the second end in electrical contact with the faucet handle, the contact spring formed of an electrically conductive material;

a valve cartridge secured within the faucet spout by the bonnet nut, the valve cartridge including a valve stem coupled to the faucet handle; and wherein an electrically conductive path extends from the faucet handle, the contact spring, the bonnet nut and the faucet spout.

22. The electronic faucet of claim 21, further comprising:

a capacitive sensor operably coupled to the faucet spout; and a controller operably coupled to the capacitive sensor, an output signal from the capacitive sensor being supplied to the controller.

23. The electronic faucet of claim 21, wherein the bonnet nut includes external threads, the spout includes internal threads engaging the external threads of the bonnet nut, the valve cartridge including an outer housing with a lip engaged by a lower end of the bonnet nut.

24. The electronic faucet of claim 23, wherein the contact spring is received within an upper opening of the bonnet nut.

25. The electronic faucet of claim 21, wherein:

the faucet handle includes:

a handle body, a receiver defined by the handle body and including at least one vertically tapered side wall defining a receiving chamber, a slot extending through the tapered side wall into the receiving chamber, and a wire form retainer, coupled around the receiver and being at least partially disposed within the slot for extending into the receiving chamber;

the valve stem is tapered and includes a retaining groove; and wherein the valve stem is received within the receiving chamber of the receiver so that at least a portion of the wire form retainer extends through the slot of the receiver and is received within the retaining groove of the valve stem.

26. The electronic faucet of claim 21, wherein the bonnet nut is formed of a polymer including carbon fibers.

27. The electronic faucet of claim 21, wherein the bonnet nut is formed of a conductive acrylonitrile butadiene styrene.

28. The electronic faucet of claim 21, further comprising an electrically operable valve in electrical communication with the controller.

29. The electronic faucet of claim 28, wherein the valve cartridge comprises a mixing valve in series with the electrically operable valve, the mixing valve in fluid communication with a hot water supply and a cold water supply.

30. An electronic faucet comprising:

a first faucet component formed of an electrically conductive material;

a second faucet component formed of an electrically conductive material;

a capacitive sensor operably coupled to the first faucet component;

a controller operably coupled to the capacitive sensor, an output signal from the capacitive sensor being supplied to the controller;

a mounting nut threadably coupled to the first faucet component, the mounting nut being formed of an electrically conductive polymer;

a valve cartridge secured within the first faucet component by the mounting nut, the valve cartridge including a valve stem coupled to the second faucet component;

a contact spring extending between a first end and a second end, the first end in electrical contact with the mounting nut, and the second end in electrical contact with the second faucet component, the contact spring formed of an electrically conductive material; and wherein an electrically conductive path extends from the second faucet component, the contact spring, the mounting nut and the first faucet component to the capacitive sensor.

31. The electronic faucet of claim 30, wherein the first faucet component comprises a faucet spout.

32. The electronic faucet of claim 30, wherein the second faucet component comprises a faucet handle.

33. The electronic faucet of claim 30, wherein the mounting nut includes external threads, the first faucet component includes internal threads engaging the external threads of the mounting nut, the valve cartridge including an outer housing with a lip engaged by a lower end of the mounting nut.

34. The electronic faucet of claim 33, wherein the contact spring is received within an upper opening of the mounting nut.

* * * * *